US008590457B2

(12) United States Patent
Schmidt et al.

(10) Patent No.: US 8,590,457 B2
(45) Date of Patent: Nov. 26, 2013

(54) LIGHTWEIGHT RERAILER

(75) Inventors: Michael J. Schmidt, Norristown, PA (US); Zachary Ryan Brook, Leola, PA (US); Manuel Tavares, Doylestown, PA (US)

(73) Assignee: Pennsy Corporation, West Chester, PA (US)

( * ) Notice: Subject to any disclaimer, the term of this patent is extended or adjusted under 35 U.S.C. 154(b) by 0 days.

(21) Appl. No.: 13/136,968

(22) Filed: Aug. 16, 2011

(65) Prior Publication Data

US 2013/0042785 A1 Feb. 21, 2013

(51) Int. Cl.
*B61K 5/00* (2006.01)

(52) U.S. Cl.
USPC ..... 104/262; 104/264

(58) Field of Classification Search
USPC ..... 104/262, 264; 246/423
See application file for complete search history.

(56) References Cited

U.S. PATENT DOCUMENTS

| | | | | |
|---|---|---|---|---|
| 45,485 | A | | 12/1864 | Fowler |
| 76,520 | A | | 4/1868 | Pullman |
| 131,384 | A | | 9/1874 | Baxter |
| 309,230 | A | | 12/1884 | Kelly et al. |
| 473,587 | A | | 4/1892 | Morris et al. |
| 805,175 | A | | 11/1905 | Welsh |
| 847,732 | A | | 3/1907 | Cook |
| 1,029,394 | A | | 6/1912 | Morris et al. |
| 1,092,635 | A | | 4/1914 | Denison |
| 1,106,864 | A | | 8/1914 | Desso |
| 1,117,081 | A | | 11/1914 | Parker |
| 1,150,037 | A | | 8/1915 | Jones |
| 1,164,512 | A | | 12/1915 | Harleman |
| 1,287,747 | A | | 12/1918 | Rea |
| 1,294,926 | A | | 2/1919 | Lyberger |
| 1,364,744 | A | | 1/1921 | Gallagher |
| 1,382,105 | A | | 6/1921 | McGinley |
| 1,391,819 | A | | 9/1921 | Bellows |
| 1,392,392 | A | * | 10/1921 | Bodie ..... 246/423 |
| 1,445,109 | A | | 2/1923 | Shumaker |

(Continued)

FOREIGN PATENT DOCUMENTS

| | | |
|---|---|---|
| DE | 0280185 | 11/1914 |
| GB | 0016643 | 7/1910 |

OTHER PUBLICATIONS

A. Kahn and B.K. Chen, "Evaluation of Grade 1 Austempered Ductile Iron For Application to Rail Cast Components", Proceedings of the Fifth Asia Pacific Industrial Engineering and Management Systems Conference 2004.

(Continued)

*Primary Examiner* — Jason C Smith
(74) *Attorney, Agent, or Firm* — John F. A. Earley, III; Frank J. Bonini, Jr.; Harding, Earley, Follmer & Frailey, P.C.

(57) ABSTRACT

A rerailer device for rerailing a railway vehicle onto a track, the device including a body with a ramp adapted to support a wheel of a railway vehicle thereon, a sloped face provided on said body and being configured with a slope that declines in a preferred direction toward the track on which the railway vehicle wheel is to be rerailed, and support means for supporting said sloped surface and railway vehicle wheels thereon, where the support configuration, material or combinations of configurations and materials facilitate lightweight construction.

32 Claims, 7 Drawing Sheets

(56) References Cited

U.S. PATENT DOCUMENTS

| | | | | | |
|---|---|---|---|---|---|
| 1,542,737 | A | | 6/1925 | Skates | |
| 1,742,467 | A | * | 1/1930 | Gakle | 104/262 |
| 1,787,329 | A | * | 12/1930 | Sexe | 104/262 |
| 1,821,880 | A | * | 9/1931 | Connick | 104/262 |
| 2,183,181 | A | | 12/1939 | Boone | |
| 2,589,077 | A | * | 3/1952 | Bliss | 246/423 |
| 2,593,956 | A | | 4/1952 | Alderman | |
| 2,697,404 | A | | 12/1954 | Brunner | |
| 2,946,882 | A | * | 7/1960 | Salmi | 246/163 |
| 3,112,711 | A | | 12/1963 | Alderman | |
| 3,296,433 | A | * | 1/1967 | Rybar | 246/423 |
| 4,306,504 | A | * | 12/1981 | Charles | 104/264 |
| 4,493,265 | A | | 1/1985 | Miura | |
| 5,423,267 | A | | 6/1995 | Eklund | |
| 5,743,190 | A | | 4/1998 | Dinger et al. | |
| 5,878,897 | A | | 3/1999 | Lazzaro et al. | |
| 5,896,816 | A | | 4/1999 | Dinger et al. | |
| 7,111,560 | B1 | | 9/2006 | Frost | |

OTHER PUBLICATIONS

Luis Magalhães, Jorge Seabra, "Teeth Surface Failures in Austempered Ductile Iron (ADI) Gears", Gears and Transmission Workshop, Paper No. XIII, pp. 269-286, Faculdade de Engenharia da Universidade do Porto, Portugal, Jun. 5, 2003.
Item A, Prior Art Rerailer.
Item B, Prior Art Rerailer.
Item C, Prior Art Rerailer.
Item D, Prior Art Rerailer.

* cited by examiner

LIGHTWEIGHT RERAILER

BACKGROUND OF THE INVENTION

1. Field of the Invention

The present invention relates to improvements in devices that are useful for placing derailed cars and locomotives back onto the track.

2. Brief Description of the Related Art

In the operation of railroads, it is sometimes the case where railroad cars, including locomotives, become derailed as they are moving along the track. The derailment of the railroad cars is often a result of uneven loads being carried by the cars, the condition of the track, or other factors. A common cause of the derailing of railroad cars is due to the cars rocking back and forth on the tracks. The rocking may cause one or more of the cars, in particular a wheel of the car, to rock off of the rail of the track. When a car is off the track, the locomotive that is pulling or pushing the derailed car will usually possess sufficient power to continue to move the car along the track, but with the derailed car wheel or wheels being dragged along with the other cars. The derailed car generally may find itself being dragged through the gravel ballast of the track bed, or along the ties. Aside from requiring more power and energy to pull the derailed car, there is a risk of danger or injury should the derailed wheel encounter an obstruction that would impede it from continuing to move along in the direction in which it is being pulled by the locomotive. For example, where a derailed car encounters a switch, the switch may direct the derailed car in a direction different than that of the locomotive or the other cars. Even the contact of the derailed wheel with the gravel, ties or other structure has the potential to cause decoupling of the derailed car from other cars.

Traditionally, rerailers have been employed as a way to address the problem of derailed cars. Rerailers are placed along the tracks to urge the derailed wheel back onto the track. Typically, rerailers consist of a metal casting that is slotted and positioned over or next to the rail near the wheel of a derailed train car. The train engine then pushes or pulls the derailed car so that the derailed wheel runs up the rerailer and is guided back onto the track. U.S. Pat. No. 349,783, issued on Sep. 28, 1886 to E. Campbell for a "Railway Frog", discloses an arrangement of inclined plates to guide derailed wheels to the rails of the track. The '783 patent discloses a length of the frogs are thirty feet. The frogs are disclosed to be formed from short sections to facilitate handling. This means that they must be joined together when they are installed or prior to installation.

A railroad rerailer is disclosed in U.S. Pat. No. 4,306,504, issued on Dec. 22, 1981 to Leslie E. Charles. The '504 patent discloses a stationary railroad rerailing apparatus for rerailing derailed cars while the train is moving. The '504 patent discloses the use of an inclined pad of a cushioning penetrable material, such as asphalt-aggregate material, for raising the derailed car, and rigid wedges outside the track rails for cooperating with the inclined pad to raise the derailed wheels above the level of the track rails and into a rerailed position. The '504 patent requires that inner rail sections be installed, and that wedges be used to urge the derailed wheel onto the track rail.

The prior devices involve considerable installation procedures and are heavy to transport and install. Some prior devices include a body with a ramp and guide flanges that allow the derailed car to be raised and pushed toward the track rail so that the wheels end up realigned on the track rail. Because the devices must raise the railroad car or locomotive, the devices must be very strong, since they need to support the railroad car or a locomotive, which could weigh up to about 420,000 lbs. In order for the prior rerailer devices to possess the strength sufficient to accommodate multiple rerailments, the devices are constructed from high tensile strength alloy steel. Even the light weight rerailers for 90 to 150 lbs. rail, weigh between 125 and 165 lbs., while heavier models may weight upwards of 150 to 190 lbs.

Rail or track is generally measured in weight per unit of length. In the United States, for example, the rail weight is generally expressed in lbs. per yard. It is common for the rail to be expressed or referred to as lbs. For example, 132 lb rail is generally 132 lbs./yd. Rerailers are used with a variety of rail weights and sizes. Rerailers may be used with track weights from about 40 lbs to 155 lbs or greater. Non-permanent type rerailers that are used with 90 to 155 lb rail are generally well over 100 lbs. in weight. The rerailers, for example, may weigh about 124 lbs., with some non-permanent rerailers weighing in excess of 150 or 200 lbs. This makes for difficult lifting and transport of the rerailers from a location to the site of the track location where the vehicle to be rerailed is located. In addition, for safety reasons a number of railroads have mandated 50 lbs per person lifting limit. This weight limit therefore requires that rerailers weighing 150 lbs. need to be carried by at least three people, and heavier rerailers may require up to 5 people to lift and transport them. The current rerailers require costs and difficulty to move and transport.

For safety and ease of transportation and installation a need exists for a lighter weight device that may be used for rerailing derailed railroad vehicles.

SUMMARY OF THE INVENTION

An improved lightweight rerailer for facilitating the realignment of a derailed wheel of a railroad vehicle back onto the track. The rerailer may be used to rerail derailed locomotives, as well as derailed railroad cars, and as used herein, the term railroad cars includes locomotives.

The present invention provides improved rerailers that have suitable strength for use with a variety of rail sizes and weights, and may be constructed to be considerably lighter in weight than prior rerailers and yet provide suitable strength for rerailing derailed rail cars. The present invention may accomplish the result of providing a suitably strong yet lightweight rerailer by constructing the rerailer from a material that has been specially treated through an austempering process, by providing a configuration that has a support structure that is lighter in weight, and/or by providing a combination of both a specially treated austempered material and a configuration that has a support structure. Several embodiments of a light weight rerailer are illustrated, including permanent and non-permanent rerailers, as well as inside rerailers and outside rerailers (that may be used in pairs and which are bi-directional), and y-style rerailers that sit on the track rail and provide ramps on both rail sides (inner and outer). These objects and advantages are illustrated in the preferred embodiments, which are exemplary of the rerailers encompassed by the scope and spirit of the invention.

It is an object of the present invention to provide a practical and effective solution to overcome the drawbacks associated with the prior heavy rerailer designs on the market today by providing an improved rerailer that may be constructed from preferred lighter weight material with similar or better tensile strength, by configuring the improved rerailer to reduce the amount of material used in non-load bearing areas, by configuring the load bearing areas of the rerailer by reducing material in those areas, or by combinations of one or more of the foregoing.

According to one embodiment, an improved rerailer is constructed by coring out material in thick load bearing areas.

According to a preferred embodiment, a lightweight rerailer is provided which is constructed from a material that has sufficient strength to support a locomotive and other railroad cars, and which may be more easily transported due to the weight of the rerailer.

It is an object to accomplish the above objects by providing a rerailer that is constructed from austempered ductile iron (ADI). According to a preferred embodiment, the austempered ductile iron is produced by a suitable austempering process. For example, austempering of ductile iron may be accomplished by heat-treating cast ductile iron to which specific amounts of nickel, molybdenum, or copper or combination thereof have been added to improve hardenability; the quantities of the elements needed to produce the ADI from ductile iron are related to the rerailer configurations and, for example, may depend on the thickest cross sectional area of the rerailer.

Another object of the invention is to provide an improved rerailer device that is constructed from a material that has a specific gravity that is less than that of alloy steel.

Another object of the invention is to provide a rerailer device that is constructed from a material that has a specific gravity of about 0.26 lbs/in3.

According to a preferred embodiment, an improved rerailer is constructed having a dual sided configuration with a tapering upper flange and configured to provide suitable support in the load bearing areas.

According to preferred embodiments, a lightweight rerailer is provided having an improved construction for handling and transferring stress loads.

It is an object of the present invention to accomplish the above objects by providing a configuration that comprises cross directional ridges for providing suitable strength to the rerailer structure.

Preferred embodiments of the invention are configured for use with trains moving along a railway, and other embodiments may be used for specific applications when a rail car is to be rerailed. Embodiments of the rerailers include permanent type rerailers and non-permanent type rerailers, which may include inside rerailers and outside rerailers that are designed to be placed alongside a rail.

It is one object of the invention to accomplish the above objects by providing an improved rerailer that is configured for installation alongside a track rail.

It is another object of the invention to accomplish the above objects by providing an improved rerailer that is configured for installation to provide a rerailer that may be installed in a railroad bed between parallel rails of a track section, and on the outside lateral sides of the track section.

BRIEF DESCRIPTION OF THE DRAWING FIGURES

DETAILED DESCRIPTION OF THE PREFERRED EMBODIMENTS

Rerailer devices are provided in accordance with the invention. According to one embodiment, an improved rerailer is constructed as a ramp style, y-style or permanent style rerailer. One exemplary embodiment of the invention is illustrated in FIGS. 1-4, where a bi-directional, outside rerailer 10 is shown. The bi-directional rerailer 10 illustrated in FIGS. 1-4 is configured as an outside rerailer. FIGS. 10-14 illustrate an inside rerailer. The outside rerailer 10 and inside rerailer 110 preferably may be used in pairs, and positioned on opposite lateral sides of a track rail. The rerailers of the invention, such as, for example, the outside rerailers 10, 110, preferably are sized to accommodate a derailed car wheel, which may be several inches from the rail. The rerailers 10, 110 are also configured for use with optional extenders, not shown, which are designed to be positioned to extend the ramp surface of the rerailers 10, 110 for derailed cars whose derailed wheel is substantially distant from the track rail, e.g., greater than about 10 inches).

Figure 1:
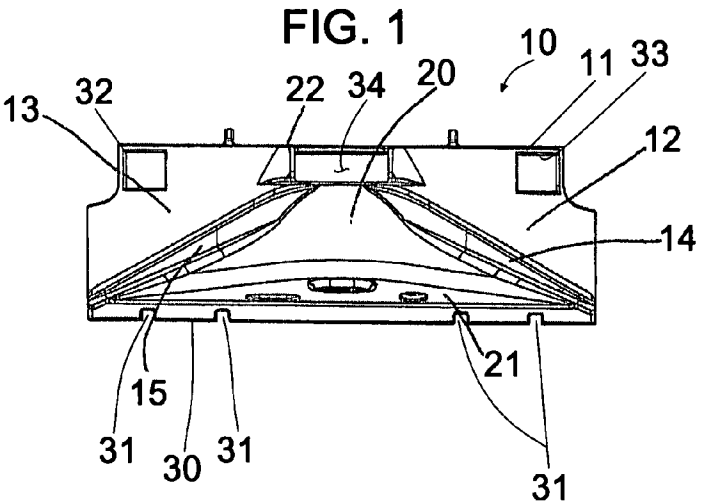
FIG. 1 is a top plan view of a preferred embodiment of a bi-directional rerailer according to the invention that is configured as an outside rerailer.

Referring to FIG. 1, there is illustrated a top view of a preferred embodiment of a bi-directional rerailer 10 having a body 11, with load bearing faces including a first load bearing face 12 and a second load bearing face 13. Guide flanges including a first guide flange 14 and a second guide flange 15, are shown provided at an edge of each respective load bearing face 12, 13. An inclined or sloped load bearing slide face 20 is provided and is sloped inwardly in the direction of the rail (when the rerailer 10 is installed, such as, for example, in the exemplary illustration of FIG. 18). The rerailer 10 also has side support walls, including a first side support wall 21 and a second side support wall 22. The second or inner side wall 22 includes a first engaging portion or surface **22*a* that is configured to engage the head of the rail 100 (see FIG. 18), and a second engaging portion 22***b* that is provided to extent toward the rail web (see FIGS. 3 and 18). A mounting flange 30 is shown on the lower edge of the first side support wall 21. The mounting flange 30 may be used to secure the rerailer to the rail with suitable mounting hardware (see FIG. 18). The mounting flange 30 preferably has apertures or grooves 31 for facilitating mounting of the rerailer 10 with a spike or other suitable mounting hardware (not shown) to a structure, such as, for example, a railroad tie. Slots 32, 33 may be provided in the body 11 of the rerailer to accommodate extension elements, not shown, that may be used in connection with the rerailer 10 to provide more surface area on which to direct derailed cars that are further from the ramp surfaces 12, 13 of the rerailer 10. A pin or other member (not shown) may be placed into the slot 32 or 33 to hold the rerailer extension (not shown) in position with the rerailer 10. According to preferred embodiments, a central aperture 34 is provided in the rerailer body 11 to facilitate mounting of an optional clamp (not shown). The clamp (not shown) may be attached to a chain, and the clamp, chain or both secured to the rail bed or rail tie to facilitate mounting of the rerailer 10. A side wall aperture 35 provided in the first side wall 21 (FIG. 4) is provided to facilitate mounting, and more particularly, for example, to permit a clamp to be inserted and mounted therethrough (see FIG. 16 where an exemplary alternate embodiment is illustrated with a clamp). Optional apertures 36, 37 are shown in the side wall 21 for facilitating transportation of the rerailer by permitting a structure, such as, for example, a chain to be inserted through the apertures 36, 37 so that the rerailer may be carried on a truck to or from the desired rerailing location.

Figure 2:
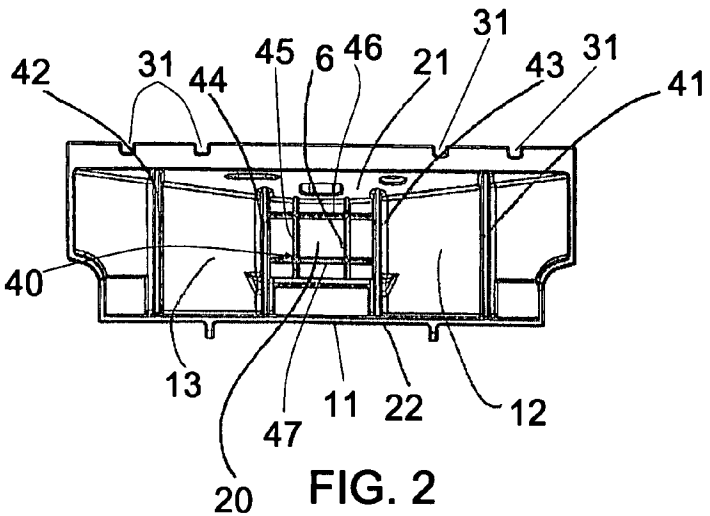
FIG. 2 is a bottom plan view of the rerailer of FIG. 1.

FIG. 2 illustrates a bottom view of the bi-directional rerailer 10. The first load bearing face 12 and second load bearing face 13 are shown comprising a layer that is disposed between the first side wall 21 and second side wall 22. Support means is provided for supporting the slide face 20 and the first and second load bearing faces 12, 13. The support means is shown configured as a supporting structure 40 having a plurality of support elements, including a plurality of transverse support ribs 41, 42, 43, 44. According to a preferred embodiment, the supporting structure 40 may also include second support ribs 45, 46, 47, 48, which preferably engage with the side support walls 21, 22 and the first plurality of transverse support ribs, such as those ribs 43, 44, shown in FIG. 2. The supporting structure 40, which, according to the preferred embodiment illustrated may include the transverse support ribs 41, 42, 43, 44 and the second support ribs 45, 46, 47, 48, is arranged to handle force loads that are imparted to the rerailer 10 from vehicle traffic, including from the wheels of a derailed railroad car passing along the rerailer 10 (see FIG. 12). The supporting structure 40 preferably is arranged to support the upper surfaces of the rerailer 20, including the slide surface 20, and, according to a preferred embodiment, as illustrated in FIG. 2, the supporting structure 40 second support ribs 45, 46, 47, 48 are disposed beneath the slide surface 20 to provide support to handle force loads transmitted to or imparted upon the slide surface 20.

Figure 4:
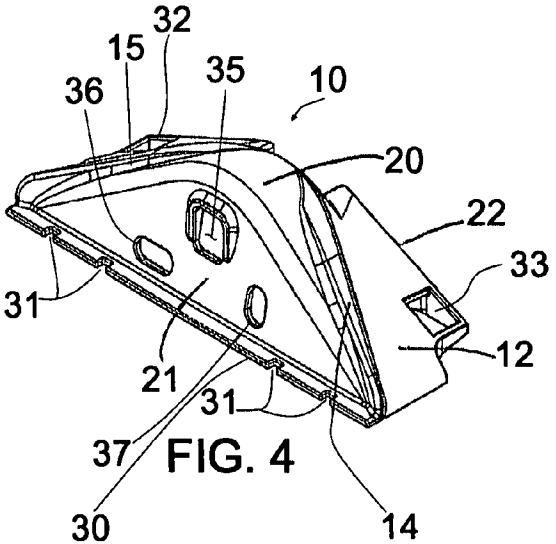
FIG. 4 is an isometric perspective view of the rerailer of FIG. 1, as viewed from the top rear.
Figure 3:
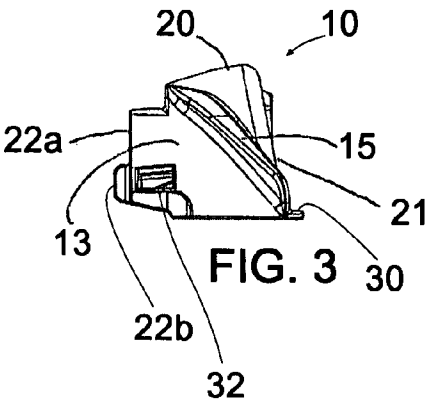
FIG. 3 is a front elevation view of the rerailer of FIG. 1.

FIG. 3 shows a front view of the bi-directional rerailer 10 and shows the second load bearing face 13, guide flange 14, sloped load bearing slide face 20 and side support walls 21, 22. The rerailer 10 is illustrated in FIG. 4 in an isometric view looking at the rerailer 10 from the first side support wall 21.

According to a preferred embodiment, the bi-directional rerailer 10 preferably is constructed from a strong material that possesses suitable strength to support a load, such as, for example, the load placed on the rerailer from the wheel of a railway car. One preferred exemplary configuration for the bi-directional rerailer 10 is a rerailer 10 where the wall thickness of the side walls has a reduced wall thickness, which may be up to about 0.5 inches, and more preferably, from about 0.20 to 0.5 inches, in cross sectional thickness, and where the guide flanges, including the first guide flange 14 and second guide flange 15, each taper from about 0.8 in. to about 1.75 in. According to a preferred exemplary embodiment, as shown in FIGS. 1-4, the non-load bearing side of the rerailer 10 which includes the first side wall 21, preferably is sloped inwardly (see FIG. 3). The sloped configuration facilitates the weight reduction by reducing the material required for the non-load structures of the rerailer 10, such as, in the exemplary embodiment, the first side wall 21. The rerailer 10 load handling strength is facilitated by the sloped guide flanges 14, 15. The flanges 14, 15 provide a bridging means for supporting the side faces, including the first side face 12 and second side face 13. According to preferred embodiments, the guide flanges 14, 15 preferably bridge one side face, such as, the first side face 14 to the other, such as the second side face 15.

Figure 5:
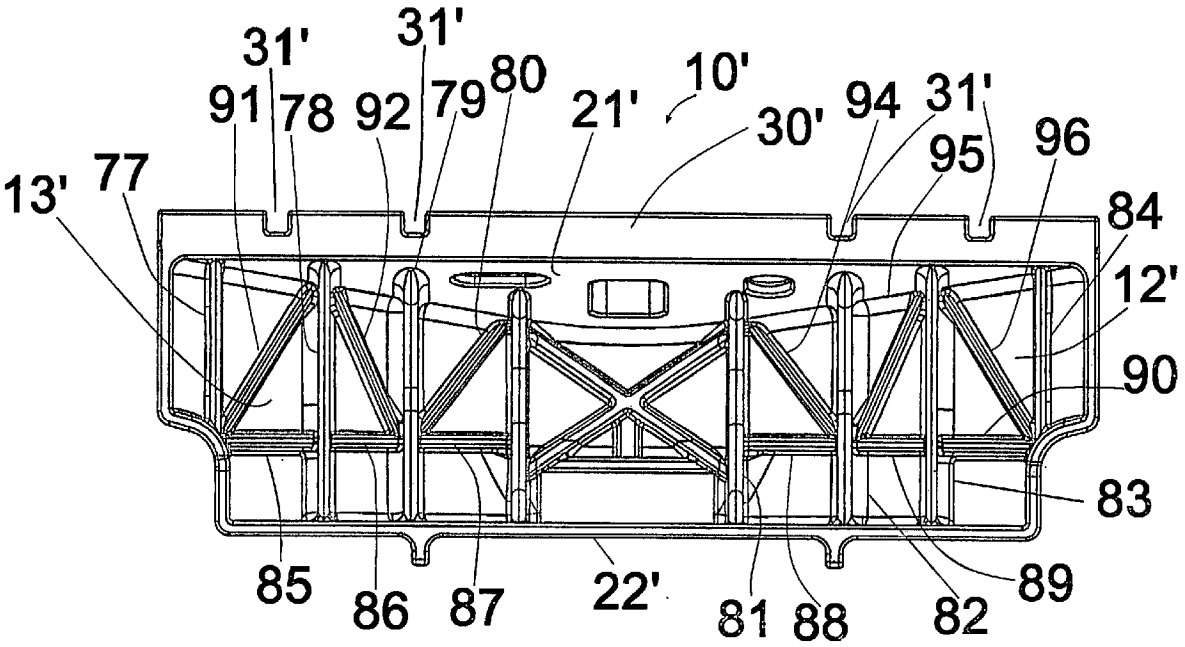
FIG. 5 is a bottom plan view of an alternate embodiment of a bi-directional, outside rerailer, with the top, bottom and front views being similar to those views of the first embodiment illustrated in FIGS. 1, 2 and 3, respectively.

Referring to FIG. 5, an alternate embodiment of a bi-directional outside rerailer 10' is illustrated, with the prime numbers used to designate elements similar to those described in connection with the rerailer 10 of FIGS. 1-4. The rerailer 10' is similar to the rerailer 10 (FIGS. 1-4), but is shown having an alternate interior configuration with a plurality of transverse support ribs 77-84 and a plurality of lateral support ribs 85-90. Connecting support ribs 91-96 are provided and engage one or more of the transverse support ribs 77-84 and the lateral support ribs 85-90.

According to some configurations, the rerailer 10 may be constructed from stainless steel or other alloy steels, and more preferably from an austempered ductile iron. According to a preferred embodiment, the lightweight features of the improved rerailer 10 may be accomplished by constructing the rerailer 10 from a suitably strong material that provides improved density characteristics. The rerailers must be suitable to withstand the weight, or portion thereof, of a passing railway car that is imparted to the rerailer by way of the derailed wheel of the car that travels on the rerailer.

The specific gravity of a substance, such as, a solid, relates the density of the substance to the density of water at 4 degrees C. Below are formulas (I) and (II) which are used to determine the specific gravity (sp gr) of solids and liquids, with water used as the standard substance.

$$sp\ gr = \frac{\text{Weight of the substance}}{\text{Weight of an equal volume of water}} \text{ or,} \quad \text{(I)}$$

$$sp\ gr = \frac{\text{Density of the substance}}{\text{Density of water}} \quad \text{(II)}$$

According to preferred embodiments, the rerailer 10 is constructed from austempered ductile iron. Austempered ductile iron is a wear resistant material, and has a specific gravity of about 0.26 lbs/in3. Alloy steel is steel that is alloyed with different elements that change the properties (e.g., hardness) of the steel alloy.

Figure 15:
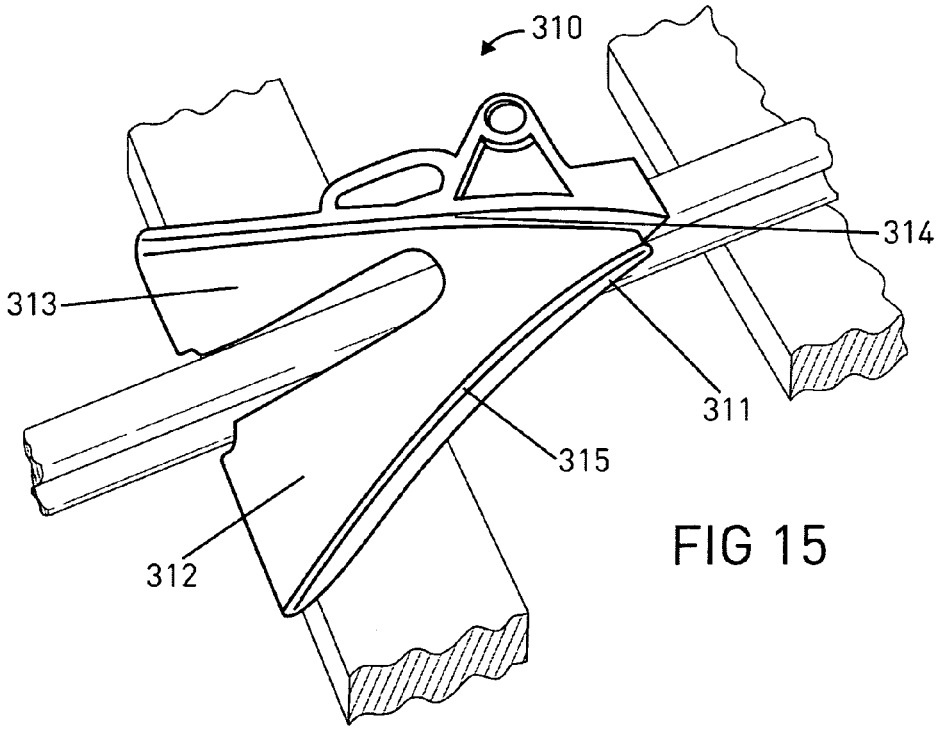
FIG. 15 is a top perspective view of a Y-style rerailer constructed in accordance with the present invention, illustrated being installed on a rail.
Figure 16:
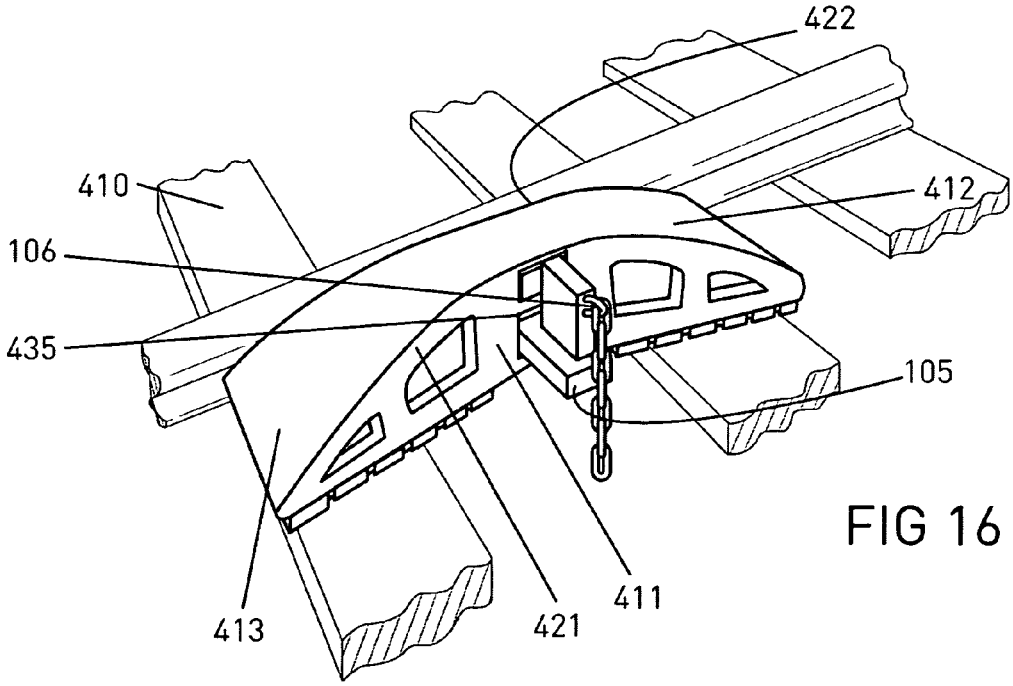
FIG. 16 is a right side perspective view of a ramp style rerailer constructed in accordance with the present invention, shown attached to a rail.
Figure 18:
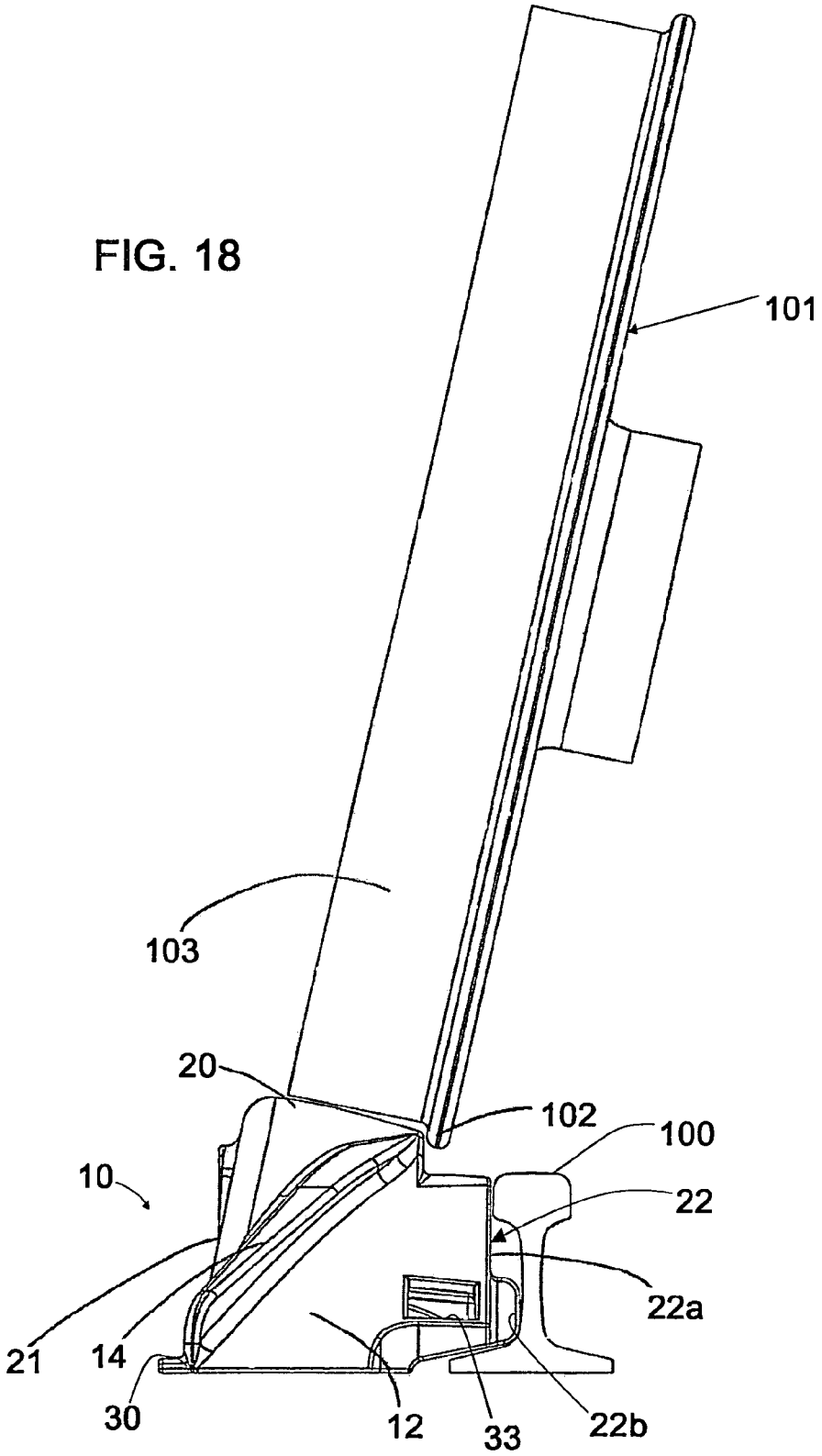
FIG. 18 is a front perspective view of the preferred rerailer of FIGS. 1-4, shown with a rail positioned against the support face of the rerailer and illustrating a wheel (shown separately from the axle and train structure) positioned at the top of the rerailer.

According to the present invention, the rerailers, such as, the outside rerailers 10, 10' and 110 in FIGS. 1-4, 5 and 6-9, respectively, the inside rerailer 210 shown in FIGS. 10-14, the y-style rerailer 310 shown in FIG. 15, the outside rerailer 410 shown in FIG. 16, and the permanent rerailer 510 of FIG. 18, may be constructed from hard materials, such as, for example, alloy steel or other suitable materials that provide sufficient strength and hardness, have support structures, such as for example, an arrangement of support ribs, or a combination of both support structures and a suitably hard material that is lightweight.

The configuration of the rerailers 10, 10' preferably provides lightweight rerailers 10, 10' that possess suitable strength for handling loads from railway cars. The sloping of the first side wall 21, 21' and the provisioning of the secondary support ribs, such as, for example, the second support ribs 45, 46, 47, 48 of the rerailer 10 and the transverse support ribs 77-84, lateral support ribs 85-90 and connecting support ribs 91-96 of the rerailer 10' (FIG. 5) provides for suitably strong rerailers 10, 10' that may utilize less alloy steel material and possess sufficient strength to support railway cars traveling on the rerailer 10, 10'. The rib configurations of the rerailer 10' provide alternate configurations for imparting suitable strength to the rerailer 10'. In addition, the inside rerailer 110 (see FIGS. 10-14) also includes a preferred arrangement of support structures so that the inside rerailer may be constructed from alloy steel to provide a lighter weight rerailer, and more preferably, may be constructed from a lighter weight material, such as, for example, austempered ductile iron, to provide a suitably strong and lighter rerailer 110.

Figure 17:
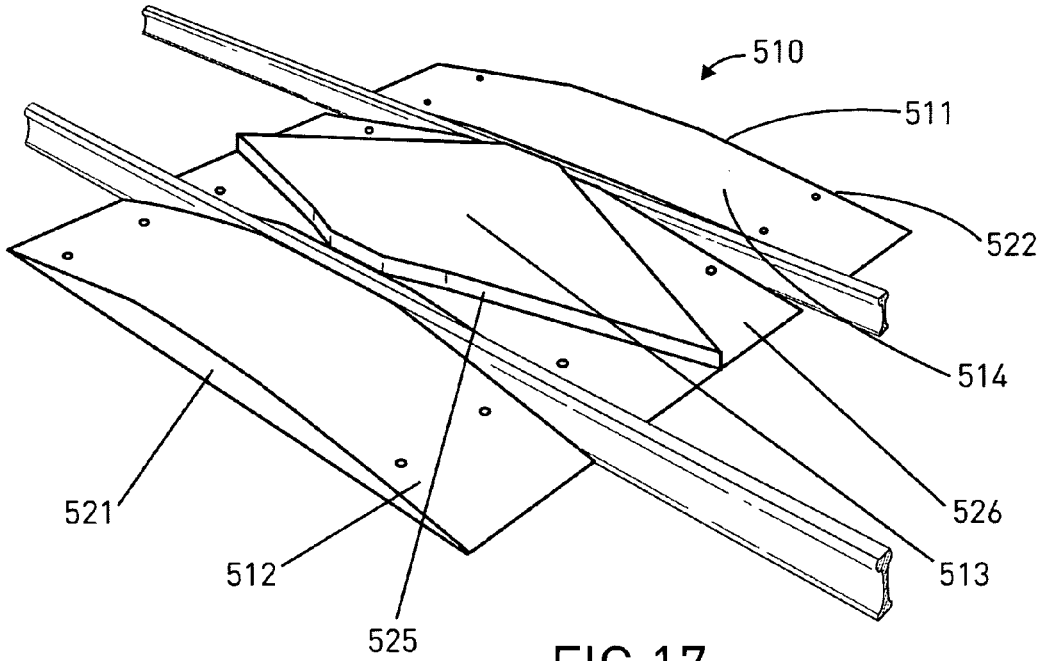
FIG. 17 is a top view of a permanent style rerailer constructed in accordance with the present invention, shown attached to the rail.

According to preferred embodiments, the lightweight rerailers 10, 10', and the other rerailer embodiments and configurations shown and described herein (e.g., rerailers 110, 210, 310, 410 and 510), may be constructed from austempered ductile iron. As illustrated in FIGS. 15, 16, and 17, the rerailers 310, 410 and 510 may be constructed from a composition that provides sufficient strength to handle forces received from railway cars passing along the track, and be constructed from lightweight material. A preferred configuration for the rerailer embodiments 310, 410 and 510 illustrated in FIGS. 15, 16, and 17, is a composition comprising austempered ductile iron (ADI). The rerailers shown and described herein may be constructed from austempered ductile iron (ADI). Through an austempering process, the iron may be enhanced to provide improved weight properties for the rerailer 10, and the other rerailers shown and described herein. The rerailers, such as, for example, the rerailer 10, may be constructed from austempered ductile iron. The austempered ductile iron is produced by a suitable austempering process. For example, one method of producing the rerailer 10, involves carrying out the austempering of ductile iron by heat-treating cast ductile iron to which small amounts of nickel, molybdenum, or copper or combination thereof have been added to improve hardenability. The rerailer 10 may be cast or forged from the austempered ductile iron. The rerailer 10 may also be machined from ductile iron and, after machining, austempered to achieved the desired strength and density characteristics suitable to provide sufficient strength to handle the operational loads that the rerailer, when installed, encounters from the derailed rail cars. The rerailer 10 may be further machined or processed to provide apertures in any of the walls, such as, for example, the first wall 21. The quantities of elements that may be incorporated in the ductile iron to form the ADI, according to preferred embodiments, depend on the configuration of the rerailer, such as, for example, the thickest cross sectional area of the rerailer. For example, according to some embodiments, the alternative support structure may be configured to have ribs, and the ribs may be provided thicker, in the case of ADI that has a lower range of hardness, and thinner in the case of ADI that has a higher range of hardness. The utilization of ADI, and the ability to austemper the ductile iron to provide ADI which is lighter and stronger than non-ADI materials, such as steel and alloy steel, provides a way to further reduce the weight of the rerailer and maintain sufficient strength for operation of the rerailer under working loads.

Although not shown in FIGS. 15, 16 and 17, according to alternate embodiments, the rerailers 310, 410 and 510, may include a support structure that may include one or more pluralities of support ribs. For example, the alternative support structures, such as the secondary support structures, which may include the secondary support and connecting ribs (shown in the embodiments of FIGS. 1-4, FIG. 5, FIGS. 6-9, and FIGS. 10-14) may be employed in the other rerailer embodiments illustrated and described herein. The provisioning of the non-solid support structures permit reduction of solid structural areas, and serve to provide a lighter rerailer. The alternate embodiments that utilize ADI for their construction and incorporate alternative support structure, such as, for example, the secondary support structure (e.g., support ribs), results in a rerailer that is lighter in weight and is suitably strong to handle loads from railway cars (e.g., derailed cars). The weight reduction with the ADI provides about a 7% reduction in comparison to alloy steel, based on the specific gravities set forth above. The further utilization of the alternative support structure, such as support ribs, provides sufficient strength without the need for solid material in the location or locations where the secondary support structure is disposed. For example, according to preferred embodiments, the rerailers 10, 10' and 110 may be provided for use with up to 90 to 155 lb rail, and the rerailers may be constructed to be about 100 lbs or less in weight. In addition, alternate rerailer weights may be constructed, and where a rerailer is required to be larger, the present construction alternative support means, material (such as ADI) or combinations of these may be used to produce a lightweight rerailer.

Figure 9:
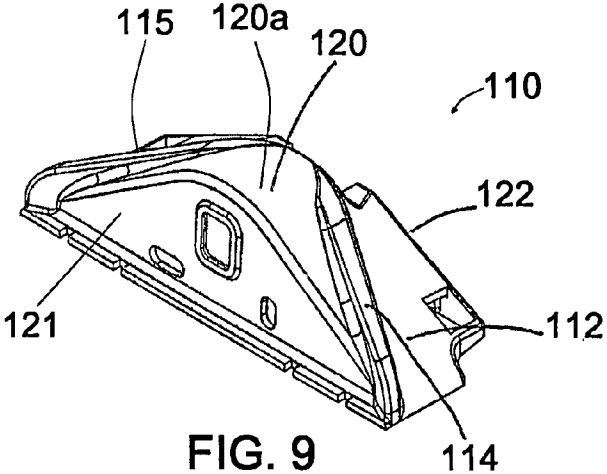
FIG. 9 is an isometric perspective view of the rerailer of FIG. 6.
Figure 8:
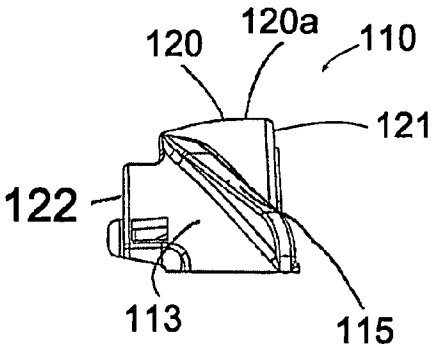
FIG. 8 is a front elevation view of the rerailer of FIG. 6.
Figure 6:
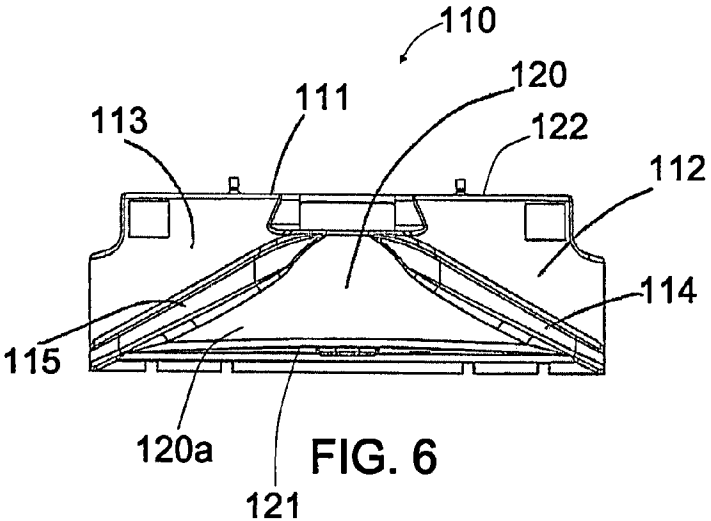
FIG. 6 is a top plan view of an alternate embodiment of a bi-directional rerailer embodiment illustrated having a ramp style configuration and being configured as an outside rerailer.
Figure 7:
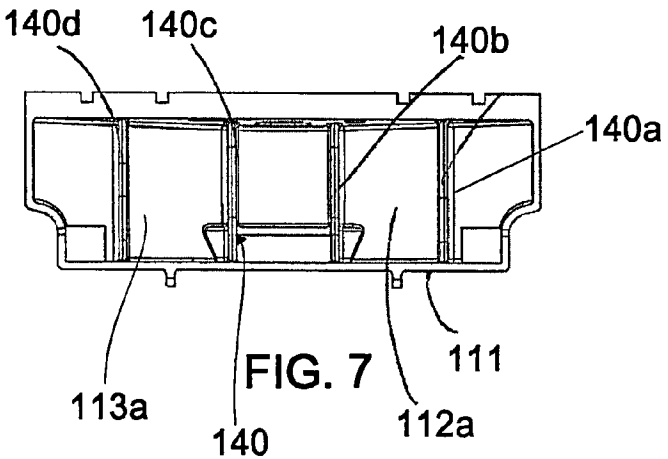
FIG. 7 is a bottom plan view of the rerailer of FIG. 6.
Figure 10:
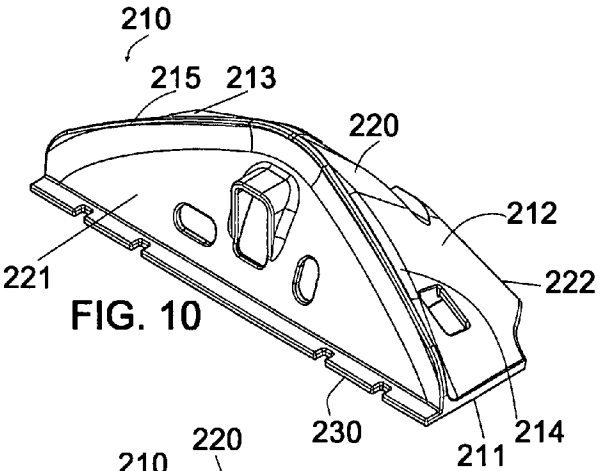
FIG. 10 is a perspective view of a bi-directional inside rerailer according to the present invention viewed from the top rear.
Figure 13:
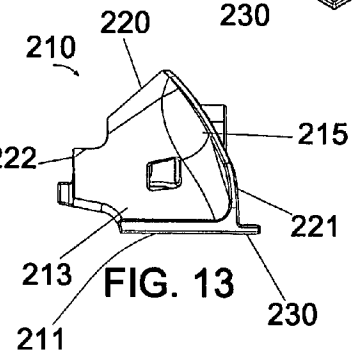
FIG. 13 is a front elevation view of the rerailer of FIG. 10.
Figure 12:
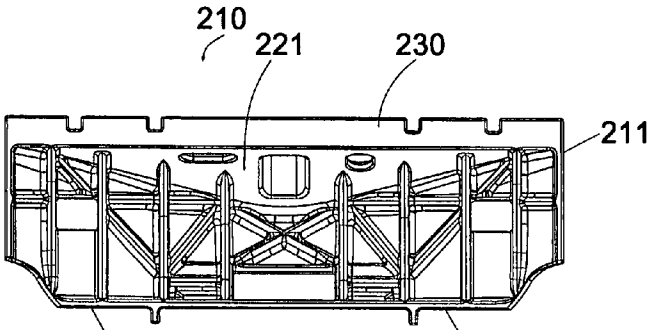
FIG. 12 is a bottom plan view of the rerailer of FIG. 10.
Figure 14:
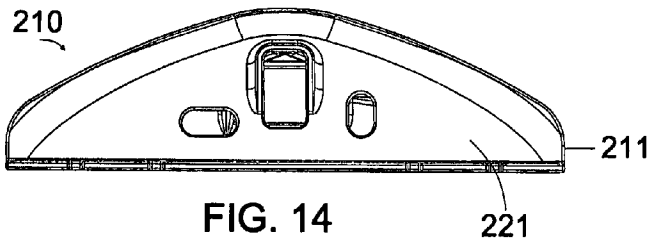
FIG. 14 is a left side elevation view of the rerailer of FIG. 10.
Figure 11:
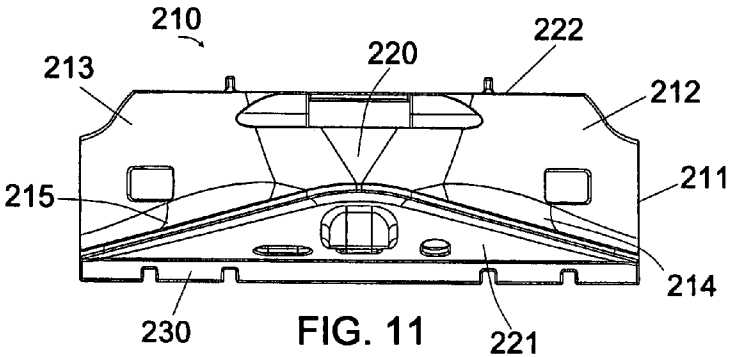
FIG. 11 is a top plan view of the rerailer of FIG. 10.

Referring to FIGS. 6-9, an alternate embodiment of an outside rerailer 110 is shown having a body 111 with load bearing faces including a first sloped load bearing face 112 and a second sloped load bearing face 113. Guide flanges including a first guide flange 114 and a second guide flange 115, are shown provided at an edge of each respective sloped load bearing face 112, 113. An inclined or sloped load bearing slide face 120 is provided and is sloped inwardly in the direction of the rail (when the rerailer 10, 10' is installed, such as, for example, similar to the rerailer 10 in the exemplary illustration of FIG. 12). The rerailer 110 also has side support walls, including a first side support wall 121 and a second side support wall 122. In the bottom view of FIG. 7, the bi-directional rerailer 110 is shown having a body 111. The undersides 112*a*, 113*a*, respectively, of the supporting faces 112, 113, are illustrated. Support means is provided for supporting the slide face 120 and the first and second sloped load bearing faces 112, 113. The support means is shown configured as a supporting structure 140 having a plurality of support elements 140*a*, 140*b*, 140*c*, 140*d*. According to the exemplary embodiment illustrated in FIG. 7, the rerailer 110 includes a first side wall 121 and a second side wall 122, and the support elements 140*a*, 140*b*, 140*c*, 140*d* preferably are connected to the side walls 121, 122. Referring to FIG. 8, there is illustrated a non-load bearing face 120*a*, that preferably is adjacently disposed in relation to the sloped load bearing face 120. The load bearing face 120 and non-load bearing face 120*a*, may preferably form a single face having a portion of which is sloped and forms the load bearing face 120, and another portion of which is substantially planar or not sloped and is designated the non-load bearing face, such as the portion 120*a*. FIG. 9 shows a front view of the preferred embodiment of the bi-directional rerailer 110, shown with a body 111, sloped load bearing face 112, guide flanges 114, 115, sloped load bearing slide face 120 with non-load bearing flat face 120*a* and side support walls 121, 122.

An inside rerailer 210 is shown in FIGS. 10-14, including a body 211, sloped load bearing faces 212, 213 guide flanges 214, 215, sloped load bearing slide face 220 and side support walls 221, 222. A mounting flange 230 may be provided similar to the flange 30 illustrated in FIGS. 1-4. A supporting structure is illustrated comprising a plurality of support ribs, including, transverse ribs, lateral ribs and connecting ribs. The arrangement of the alternative support structure shown in FIG. 12 may be similar to the alternative support structures shown and described herein in connection with the rerailer embodiments 10, 10' shown in FIGS. 2, 5 and 7. The exemplary rerailer 210 shows an inside rerailer, which, according to preferred embodiments, in addition to the alternative support structure, may be constructed from ADI to provide a lightweight rerailer 210.

As illustrated in FIG. 15, a third alternate embodiment of a rerailer 310 is illustrated configured as a ramp styled rerailer 310 having a generally Y-shape. The rerailer 310 has a body 311, load bearing faces 312, 313, guide flanges 314, 315. The rerailer 310 preferably is constructed from a lightweight and suitably strong material, such as, austempered ductile iron. According to an alternate configuration, although not shown in FIG. 15, the rerailer 310 may be provided with support means, such as, those shown and described herein in connection with the rerailer embodiments 10, 10', 110 and 210 of FIGS. 1-4, 5, 6-9 and 10-14, respectively.

Referring to FIG. 16, an alternate embodiment of a bi-directional ramp rerailer 410 is shown having a body 411, sloped load-bearing faces 412, 413, and side support walls 421, 422. The rerailer 410 preferably may be constructed similar to prior type rerailer configurations that previously were constructed from steel or steel alloys. The rerailer 410 is constructed from austempered ductile iron. The rerailer 410 is shown having an aperture 435 in the first wall 421 for receiving a clamp 105 secured with a chain 106. An alternate embodiment of a permanent style ramp rerailer 510 is shown in FIG. 17 having a body 511, sloped load bearing faces 512, 513, 514, side support walls 521, 522 and guide flanges 525, 526. The rerailer 510 is constructed from austempered ductile iron, which imparts suitable strength to the rerailer to handle a derailed wheel of a rail car that may travel along the load bearing faces 512, 513, 514. The austempered ductile iron provides for a strong yet lightweight rerailer 510.

Referring to FIG. 18, a front view of a preferred embodiment of the bi-directional rerailer 10 of FIGS. 1-4 is shown positioned in an installed condition adjacent a rail 100, with a wheel 101 of a rail car being shown (the rail car not shown). The head of the rail 100 is shown positioned against the support face 22*a* and the wheel 101 is positioned at the top load bearing slide face 20 showing it is positioned to slide in a direction toward the support face 22 and toward the rail 100. The second engaging portion 22*b* of the rerailer face 22 is shown engaging the web of the rail 100.

According to the preferred embodiment of the rerailer 10 illustrated in FIGS. 1-4 and shown in FIG. 18, the support face 22 is placed on the side of the rail 100, which the wheel 101 is sitting so the wheel 101 may roll up one of the sloped surfaces 12, 13 of the rerailer 10. As the wheel 101 begins to roll up the incline of the sloped surface 20, the wheel 101 will contact the rerailer body 11 at a load bearing face 12 or 13 (depending on from which direction the train is being moved). The wheel flange 102 will begin to roll up the load bearing face 12 or 13 until the wheel flange 102 engages one of the rerailer guide flanges 14, 15, respectively, which will direct the wheel 100 and guide it in a direction toward the support face 22 and toward the track 100. As the wheel 101 is moved along the rerailer body 11 and up the incline of a load bearing face 12 or 13, the wheel 100 ultimately should reach the top of the rerailer body 11 and the load bearing slide face 20. When the wheel 100 reaches the load bearing slide face 20, the wheel tread 103 will be angled and encouraged by the sloped surface 20 to move or slide in a direction toward the support face 22 and toward the track 100 allowing the derailed wheel 100 to slide back onto the track 101 in its proper aligned and rerailed position.

The lightweight rerailers shown and described herein preferably may be constructed utilizing an industry standard process of casting and heat treating to achieve the desired austempered ductile iron grade. In view of the foregoing, it may be seen that many embodiments of the preferred rerailer may be taken to achieve the desired lower weight. In addition, the alternative support structures, such as, for example, the second support structures, may be provided in configurations other than the support rib configurations shown in the preferred embodiments in FIGS. 2, 5, and 12, and preferably the second support structures engage with other support structures and the walls of the rerailer. The cross directional ridges or structures provided in the rerailer bodies preferably are configured to receive forces imparted on the rerailer ramp and sloped face or faces. For example, the configuration of multi-directional ribs facilitates the force handling from forces exerted on the surfaces, such as the ramps and sloped faces. For these reasons, a latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

We claim:

1. A rerailer for rerailing a railway vehicle onto a track, the device comprising:

a body with a ramp adapted to support a wheel of a railway vehicle thereon;

a sloped face provided on said body and being configured with a slope that declines in a preferred direction toward the track on which the railway vehicle wheel is to be rerailed;

support means for supporting said sloped face and railway vehicle wheels thereon; and an alternative support structure for supporting said ramp and said sloped face to provide load handling support when the wheel of a derailed rail car is received thereon, wherein said support means for supporting said sloped face and railway vehicles therein includes a first wall and a second wall, wherein said alternative support structure comprises a cavity formed between said first wall and said second wall and a plurality of support elements disposed within said cavity and being interconnected with said first wall and said second wall;

wherein said device is constructed from an austempered metal.

2. The rerailer of claim 1, wherein said device is constructed from austempered ductile iron.

3. The rerailer of claim 1, wherein said ramp is disposed in a cooperative relationship with said sloped face to facilitate directing of a railway vehicle wheel toward a track.

4. The rerailer of claim 1, wherein said supporting elements comprise first support ribs and second support ribs.

5. The rerailer of claim 4, wherein said first wall comprises a first side wall and wherein said second wall comprises a second side wall, and wherein at least some of said support ribs engage with said side walls.

6. The rerailer of claim 5, wherein said first ribs comprise transverse ribs.

7. The rerailer of claim 1, wherein said body includes a first ramp and a second ramp which are spaced apart to define a rail space there between, said sloped face including a sloped face on said first ramp and a sloped face on said second ramp, wherein said first ramp sloped face comprises a top surface and wherein said first ramp has a bottom face on the opposite side of said sloped face, wherein said second ramp sloped face comprises a top surface and wherein said second ramp has a bottom face on the opposite side of said second ramp sloped face, wherein said cavity is provided below said first ramp and said second ramp sloped faces, and wherein said plurality of support elements are arranged in said cavity along the bottom surface of said first ramp and along the bottom surface of said second ramp.

8. The rerailer of claim 7, wherein said plurality of support elements comprise a plurality of support ribs.

9. The rerailer of claim 8, wherein said supporting elements comprise first support ribs and second support ribs.

10. The rerailer of claim 9, wherein said first wall comprises a first side wall and wherein said second wall comprises a second side wall, and wherein at least some of said support ribs engage with said side walls.

11. The rerailer of claim 10, wherein said first ribs comprise transverse ribs.

12. The rerailer of claim 7, wherein said plurality of support elements are formed on the bottom surface of said first ramp and on the bottom surface of said second ramp.

13. The rerailer of claim 7, wherein said alternative support structure comprises cross directional ridges disposed in said body.

14. The rerailer of claim 1, wherein said device is configured as an inside rerailer.

15. The rerailer of claim 1, wherein said device is configured as an outside rerailer.

16. The rerailer of claim 1, wherein said alternative support structure comprises cross directional ridges disposed in said body.

17. The rerailer of claim 16, wherein said cross-directional ridges are configured to receive forces imparted on said ramp and said sloped face.

18. The rerailer of claim 1, wherein said first wall and said second wall each has a cross-sectional wall thickness of about 0.5 inches.

19. The rerailer of claim 18, wherein said first wall and said second wall each has a cross-sectional wall thickness of about 0.20 to 0.5 inches.

20. The device of claim 19, wherein said device has guide flanges, including a first guide flange and a second guide flange, wherein each said guide flange tapers in cross-sectional thickness from about 0.8 in. to about 1.75 in.

21. The rerailer of claim 9, wherein said rerailer is constructed having a weight of less than 100 lbs.

22. The rerailer of claim 1, wherein said device has guide flanges, including a first guide flange and a second guide flange, wherein each said guide flange tapers in cross-sectional thickness from about 0.8 in. to about 1.75 in.

23. The device of claim 1, wherein said austempered ductile iron consists essentially of austempered ductile iron having a specific gravity of about 0.26 lbs/in3.

24. The rerailer of claim 1, wherein said rerailer is constructed having a weight of less than 100 lbs.

25. The rerailer of claim 1, wherein said plurality of support elements disposed within said cavity and being interconnected with said first wall and said second wall comprise ribs.

26. The rerailer of claim 25, wherein said ribs are substantially shorter in height than the height of said first wall and said second wall.

27. The rerailer of claim 1, wherein said plurality of support elements are arranged in said cavity to support the sloped face.

28. The rerailer of claim 27, wherein the sloped face has an underside and wherein said plurality of support elements are formed on the underside of said sloped face.

29. The rerailer of claim 1, wherein said sloped face has an underside and wherein said plurality of support elements are formed on the underside of the sloped face.

30. The rerailer of claim 29, wherein said alternative support structure comprises cross directional ridges disposed on the underside of the sloped face.

31. The rerailer of claim 1, wherein said first wall has a top and a bottom, wherein said second wall has a top and a bottom, wherein said support elements comprise support ribs, and wherein said plurality of support ribs are disposed substantially raised in relation to the bottom of said first wall and said second wall.

32. The rerailer of claim 1, wherein said alternative support structure comprises a plurality of cavities formed between said first wall and said second wall, said plurality of support elements being disposed within said plurality of cavities and being interconnected with said first wall and said second wall.

* * * * *